US006385499B1

(12) United States Patent
Mattke et al.

(10) Patent No.: US 6,385,499 B1
(45) Date of Patent: May 7, 2002

(54) METHOD FOR PREPARING MEMORIAL PRODUCTS, APPARATUS FOR PREPARING MEMORIAL PRODUCTS, AND MEMORIAL PRODUCT

(75) Inventors: John H. Mattke, Buffalo; Bernard J. Frie, Saint Joseph, both of MN (US)

(73) Assignee: Cold Spring Granite Company, Cold Spring, MN (US)

( * ) Notice: Subject to any disclaimer, the term of this patent is extended or adjusted under 35 U.S.C. 154(b) by 0 days.

(21) Appl. No.: 09/140,082

(22) Filed: Aug. 25, 1998

(51) Int. Cl.[7] ..... G06F 19/00
(52) U.S. Cl. ..... 700/159; 700/169; 52/103
(58) Field of Search ..... 700/159, 160, 700/117, 182, 163; 40/124, 5, 596; 52/103

(56) References Cited

U.S. PATENT DOCUMENTS

| | | | | |
|---|---|---|---|---|
| 320,488 A | | 6/1885 | McKellar | |
| 4,790,088 A | | 12/1988 | Morvant | 40/124 |
| 5,117,366 A | * | 5/1992 | Stong | 700/182 |
| 5,197,013 A | * | 3/1993 | Dundorf | 700/182 |
| 5,363,609 A | * | 11/1994 | Hancovsky | 52/103 |
| 5,379,499 A | | 1/1995 | Jackson | 27/1 |
| 5,517,791 A | | 5/1996 | Weiss | 52/103 |
| 5,622,014 A | | 4/1997 | Weiss | 52/105 |
| 5,625,933 A | | 5/1997 | Neuberger et al. | 27/1 |
| 5,822,209 A | * | 10/1998 | Fischer | 700/160 |

* cited by examiner

*Primary Examiner*—William Grant
*Assistant Examiner*—Kidest Bahta
(74) *Attorney, Agent, or Firm*—Merchant & Gould P.C.

(57) ABSTRACT

A method implemented by a computer controlled routing machine for generating memorial products having recessed memorial information therein is provided. The method includes inputting data representing memorial information into a computer to provide inputted data, processing the inputted data to provide instructions for controlling a routing machine, and routing memorial information into a metal surface according to the instructions to provide a memorial product. A computer controlled routing apparatus for generating memorial products having recessed memorial information therein is provided.

13 Claims, 2 Drawing Sheets

METHOD FOR PREPARING MEMORIAL PRODUCTS, APPARATUS FOR PREPARING MEMORIAL PRODUCTS, AND MEMORIAL PRODUCT

FIELD OF THE INVENTION

The invention relates to a method for preparing memorial products, an apparatus for preparing memorial products, and a memorial product. In particular, the invention relates to a computer controlled method and apparatus for recessing memorial information into a metal surface to provide a memorial product.

BACKGROUND OF THE INVENTION

Memorial products are commonly prepared by a casting process. Typically, a pattern is formed which includes memorial information such as an epitaph and design. The epitaph and design are generally raised. That is, they extend away from the surface of the pattern. A considerable amount of labor is generally required to hand place the letters on the pattern for providing the epitaph information. In addition, designs often require the preparation of a separate pattern which involves cutting away portions of a material to provide the desired design features. The pattern is then used to create a mold. In general, a mixture of silica, sand, and resin is packed around the pattern. The mold is separated and the pattern is removed. Then molten metal, such as a bronze alloy, is poured into the mold to create a memorial product. The surface of the memorial product is then trimmed and polished to provide a desirable finish. The production of memorial products by casting is a fairly labor intensive and time consuming process.

SUMMARY OF THE INVENTION

A method implemented by a computer controlled routing machine for generating memorial products having recessed memorial information therein is provided by the present invention. The method includes steps of inputting data representing memorial information into a computer to provide inputted data, processing the inputted data to provide instructions for controlling a routing machine, and routing memorial information into a metal surface according to the instructions to provide a memorial product.

It should be appreciated that memorial information generally refers to epitaph information and designs. In general, an epitaph includes a brief statement commemorating or epitomizing a deceased person or something past, and usually includes dates. An epitaph can refer to a deceased person or a thing or event. In the case of a deceased person, the epitaph generally includes dates of birth and death, and often a brief statement about the deceased person or by the deceased person, handwritten personal information, poem, and/or signature. The epitaph may additionally include a hand or palm imprint or a foot imprint. Artistic designs are generally popular on memorial products. Exemplary types of designs commonly found on memorial products include angels, religious emblems, and floral borders.

The memorial information can be inputted into the computer using any commonly available type of inputting device. Exemplary inputting devices include scanners, keyboards, and mouse or menu driven software. Preferably, a signature or handwritten letter or poem can be inputted into the computer by scanning.

The metal surface is preferably part of a metal plate which can be fed to the routing machine. In the case of memorial products, bronze is a commonly used metal material. In general, bronze is a material which includes at least about 50% by weight copper. In the case of bronze for use as a memorial product, it is advantageous to provide the copper component in an amount of about 87% by weight or higher. It should be appreciated, however, that various types of materials can be processed by the invention. Bronze is preferable because of its longevity.

A computer controlled routing apparatus for generating memorial products having recessed memorial information therein is provided by the present invention. The apparatus includes a computer including a processor and data storage, a data input device, and a routing machine. The data input device is provided for inputting data representing memorial information into the computer. The processor is provided for processing inputted data, optionally in combination with data provided in the data storage, and providing instructions for controlling the routing machine. The routing machine is provided for receiving instructions from the computer and routing memorial information into a surface of a metal plate to provide a memorial product.

A method for preparing a memorial product is provided by the present invention. The method includes steps of providing a metal substrate, at least a portion of the substrate including a surface for receiving recessed memorial information, and recessing memorial information into the surface for receiving recessed memorial information to provide a metal substrate having recessed memorial information. Preferably, the memorial information includes lettering. The method can further include a step of attaching the metal substrate having recessed memorial information to a stone. Lettering is preferably routed to a depth of at least about 1/16inch to provide sufficient relief. In order to avoid providing too much relief, lettering is preferably recessed to a depth of no greater than about 1/8inch below the substrate surface.

A memorial product is provided according to the present invention. The memorial product includes a bronze plate having a surface including recessed lettering. The recessed lettering is provided at a depth of at least about 1/16inch below the surface of the bronze plate. Preferably, the lettering is provided at a depth which is not greater than about 1/8inch below the bronze plate surface.

DETAILED DESCRIPTION OF THE INVENTION

A memorial product is provided having memorial information therein. In the context of a memorial product, it should be understood that the phrase "memorial information" generally refers to epitaph information and designs. In general, an epitaph includes a brief statement commemorating or epitomizing a deceased person or something past, and usually includes names and dates. In the case of a deceased person, the epitaph generally includes dates of birth and death, and often a brief statement about the deceased person or by the deceased person, handwritten personal information, a poem, and/or a signature. In the case of infants or small children, the epitaph may include a hand or palm imprint or a foot imprint. Designs are often popular on memorials. The designs are generally artistic in nature. Popular design provided on memorials for deceased persons include angels, religious emblems, and floral borders.

According to the invention, at least a portion of the memorial information can be recessed into the surface of a metal substrate. Applicants have discovered that by recessing at least a portion of the memorial information into the surface of a metal substrate, it is possible to provide a relief of the memorial information while avoiding the time consuming and labor intensive technique steps provided by the prior casting techniques. Accordingly, a memorial product can be customized more quickly and at a lower cost by recessing memorial information compared with prior casting techniques.

Recessed memorial information includes relief information which is provided below the surface of the memorial product. In contrast to raised memorial information provided by conventional casting techniques, recessed memorial information can be provided by routing or engraving into the surface of the memorial product. In the case where the information includes lettering, the lettering is preferably provided at a depth of between about 1/16inch and about 1/8inch. It should be appreciated that the recessed memorial information is preferably provided at a depth which will provide the desired relief. To provide desired relief in bronze, it is generally desirable to recess to a depth of at least about 1/16.

Figure 1:
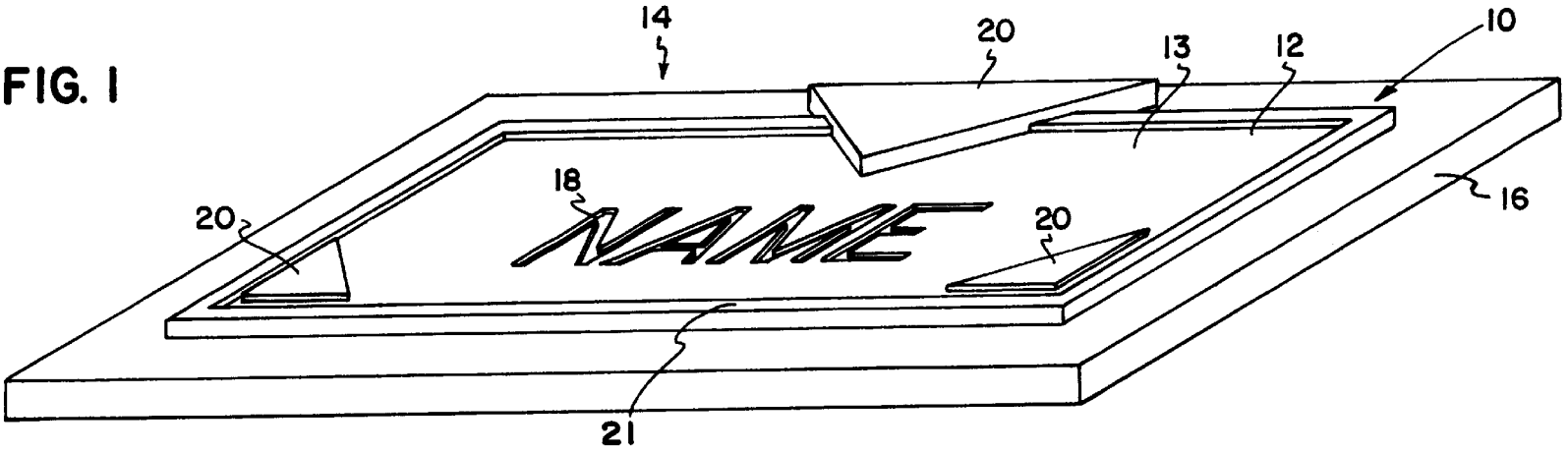
FIG. 1 is a memorial product including recessed lettering a cast design according to the present invention.

Now referring to FIG. 1, a memorial product according to the invention is provided at reference numeral 10. The memorial product 10 includes a metal plate 12 and memorial information 14. As shown, the memorial product 10 is mounted to a stone base 16, but can be mounted to the other type of desired surface including a wall. Alternatively, the memorial product 10 can be provided without a base and used as a marker. That is, the memorial product can be laid upon the ground or placed on a surface to act as a marker. When attached to a stone base 16, it is preferable that the stone base is granite. Alternatively, the stone base 16 can be a marble or a synthetic stone product.

The metal plate 12 is preferably a metallic material having a surface 13 which can be machine recessed in order to provide the recessed memorial information 18. Preferably, the metal plate 12 includes a bronze alloy. In general, a bronze alloy contains at least about 50% by weight copper. A preferred bronze alloy includes about 87% copper, about 5% tin, about 2% zinc, and about 1% lead. It should be appreciated, however, that the bronze alloy which can be used according to the invention is not limited to the preferred bronze alloy identified above.

The dimensions of the metal plate can certainly vary depending upon a application. In the case of a metal plate which is intended to be used as a memorial marker at a grave site, the metal plate preferably has a thickness of between about 0.5 inch and 2 inches. When used as a marker at a grave site, it is preferable that the metal plate has a length of between about 24 inches and 60 inches, and a width of between 14 inches and 30 inches.

The memorial information 14 can include any type of information commonly found on memorialization products. The recessed memorial information 18 in FIG. 1 is shown as "NAME" and is intended to include the name of the deceased person as well as any other desired type of epitaph information including the birth and death dates of a deceased, personal information or letters, handwritten information, signatures, poems, hand or palm imprints, and foot imprints. Raised memorial information 20 can include any type of epitaph or design information. Exemplary types of design information includes artistic work including, for example, angels, religious emblems, and floral designs. A border 21 is shown which is preferably a floral border.

By recessing at least a portion of the memorial information, it is possible to avoid the time and labor intensive steps required in prior art casting operations for that information while providing the memorial information in relief. In the case of memorial product 10, the metal plate 12 can be provided as a cast metal plate including raised memorial information 20 and 21. The memorial product 10 can then be customized for a particular person or thing by introducing the recessed memorial information 18.

The recessed memorial information 18 is preferably provided by routing or inscribing into the surface 13 of the metal plate 12. That is, the information is not provided in a raised fashion which is commonly the result of a casting process. Accordingly, the recessed memorial information 18 can be referred to as routed information.

Figure 2:
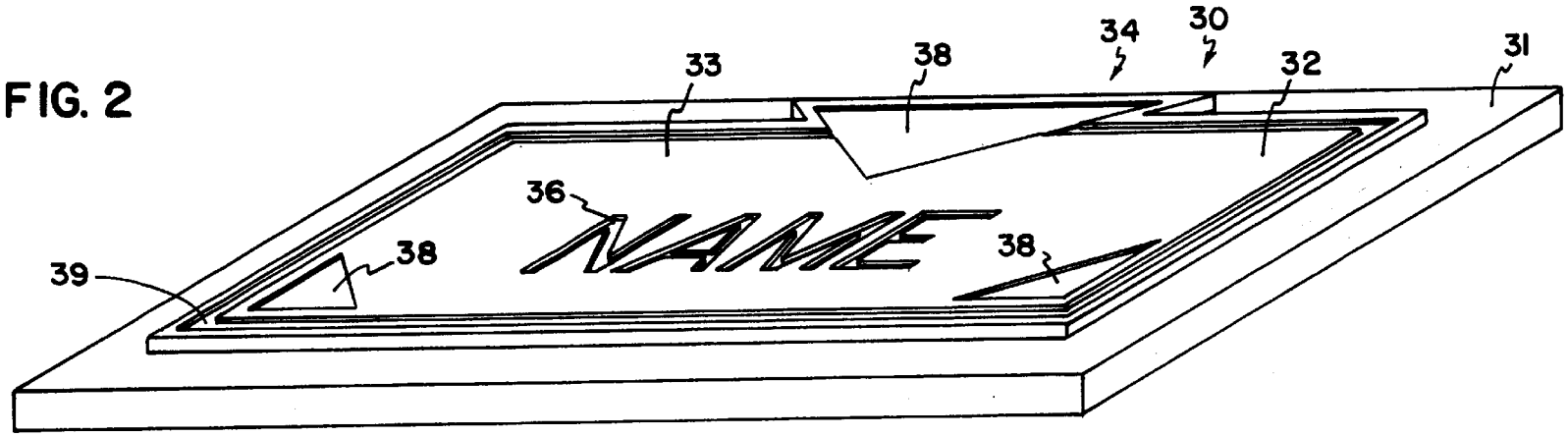
FIG. 2 is a memorial product including recessed lettering and recessed design according to the present invention.

Now referring to FIG. 2, a memorial product 30 is provided mounted on a stone base 31. The memorial product 30 includes a metal plate 32 having a surface 33 including recessed memorial information 34 including epitaph information 36 and design information 38. Additionally included is an optional recessed border design 39. The metal plate 32 can be a cast plate or a rolled plate. The memorial product 30 is shown without any relief created by casting. Accordingly, the entire relief can be introduced into the surface 33 by routing or engraving.

Figure 3:
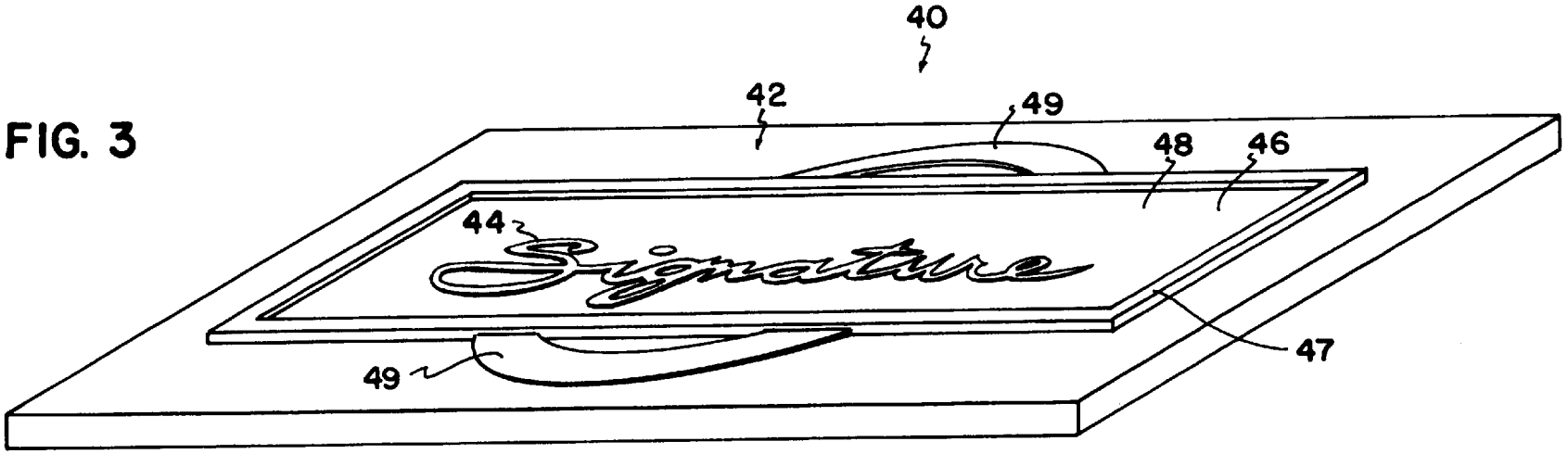
FIG. 3 is a memorial product including recessed signature according to the present invention.

Now referring to FIG. 3, a memorial product 40 is provided which includes memorial information 42 including a recessed signature 44 in the surface 46 of the metal plate 48. The signature 44 can be provided as a copy of the signature of the deceased person. Design information 49 including a border 47 can be provided as either recessed information (by routing) or raised information (by casting).

Figure 4:
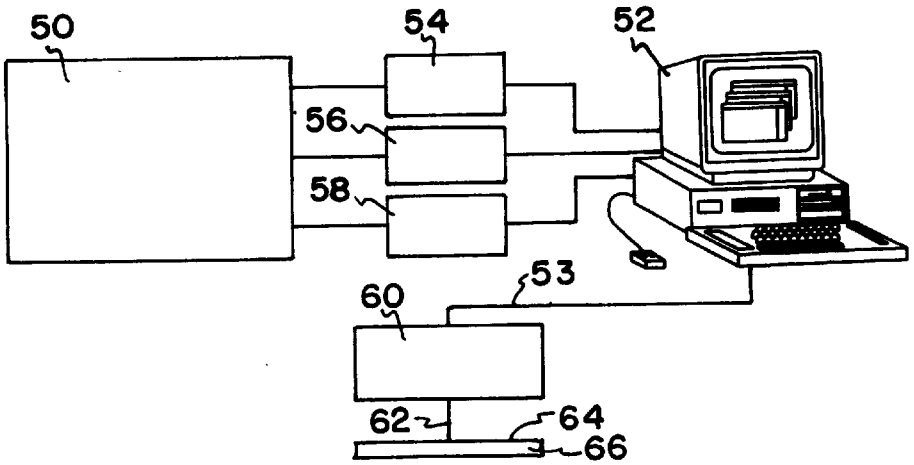
FIG. 4 is a schematic diagram showing the method for manufacturing a memorial product according to the present invention.

Now referring to FIG. 4, a schematic diagram is provided showing a preferred method for manufacturing a memorial product. Information 50 can be inputted into a computer 52 by using a scanner 54, a keyboard 56, a mouse 58 or any combination of these or any other type of data input device. The inputted information is then processed by the processor in the computer 52 into a language 53 suitable for controlling the operation of a routing machine 60. The processing of the information includes cleaning up certain lines and/or angles to provide a desired relief information 62 for recessing into the metal surface 64. The routing machine 60 then recesses the relief information 62 into the metal surface 64. Preferably, the metal surface 64 is part of a metal plate 66 which is preferably a bronze alloy.

The computer is preferably driven by a graphics software package. A preferred graphics software package which can be used is available as Scanveg software from Scanveg of Chicago, Illinois. A preferred routing machine which can be used according to the invention is available from Komo Machine, Inc. of Saulk Rapids, Minn. as the CNC Router. The router preferably has a variable speed spindle, movable set up, and lubricant free tool. When routing bronze, it is desirable to rout without the use of oils and/or water which cause staining or require additional processing for the removal thereof.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method implemented by a computer controlled routing machine for generating memorial products having recessed memorial information, the method comprising steps of:

(a) inputting data representing memorial information into a computer to provide inputted data, the memorial information comprising a copy of at least one of:
(i) handwriting;
(ii) signature;
(iii) hand or palm imprint; and
(iv) foot imprint;

(b) processing the inputted data to provide instructions for controlling a routing machine; and (c) routing the memorial information into a surface of a cast metal plate using the routing machine, wherein:
(i) the step of routing the memorial information comprising routing the memorial information to a depth of at least about 1/16inch below the surface of the cast metal placing; and
(ii) the cast metal plate comprising raised, cast design information extending above the surface of the cast metal plate, the raised cast design information provided as a result of casting.

2. A method according to claim 1, wherein said metal plate comprises a bronze alloy.

3. A method according to claim 1, wherein the cast plate comprises a bronze plate, and further comprising a step of feeding the bronze plate to the routing machine prior to the step of routing the memorial information.

4. A method according to claim 1, wherein the memorial information comprises a copy of a signature of a deceased person.

5. A method according to claim 1, wherein the memorial information further comprises an artistic design.

6. A method implemented by a computer controlled routing machine for generating memorial products having recessed memorial information, the method comprising steps of:

(a) inputting data representing memorial information into a computer to provide inputted data, the memorial information comprising customized information for a deceased person;

(b) processing the inputted data to provide instructions for controlling a routing machine; and (e) routing the memorial information into a surface of a cast metal plate using the routing machine, wherein:
(i) the step of routing the memorial information comprising routing the memorial information to a depth of at least about 1/16inch below the surface of the cast metal plate; and
(ii) the cast metal plate comprising raised cast design information extending above the surface of the cast metal plate, the raised cast design information provided as a result of casting.

7. A method according to claim 6, wherein said metal plate comprises a bronze alloy.

8. A method according to claim 6, wherein the cast plate comprises a bronze plate, and further comprising a step of feeding the bronze plate to the routing machine prior to the step of routing the memorial information.

9. A method according to clam 6, wherein the memorial information comprises a copy of a signature of a deceased person.

10. A method according to claim 6, wherein the memorial information further comprises an artistic design.

11. A memorial product for deceased person to be memorialized comprising a result of casting and routing, the memorial product comprising:

(a) a cast metal plate having raised cast design information extending above the surface of the cast metal plate, the raised cast design information being provided as a result of casting; and (b) recessed routed out memorial information provided by a step of routing to recess the memorial information to a depth of at least about 1/16inch below the surface of the cast metal plate, the memorial information comprising a copy of at least one of:
(i) handwriting;
(ii) signature;
(iii) hand or palm imprint; and
(iv) foot imprint of the deceased person to be memorialized.

12. A memorial product according to claim 11, wherein the cast metal plate comprises a bronze alloy.

13. A memorial product according to claim 11, wherein the memorial information routed into the surface of the cast metal plate further comprises an artistic design.

* * * * *

UNITED STATES PATENT AND TRADEMARK OFFICE

CERTIFICATE OF CORRECTION

PATENT NO. : 6,385,499 B1
DATED : May 7, 2002
INVENTOR(S) : Mattke et al.

It is certified that error appears in the above-identified patent and that said Letters Patent is hereby corrected as shown below:

Column 5,
Line 27, "placing" should be -- plate --

Signed and Sealed this

Fifteenth Day of October, 2002

*Attest:*

*Attesting Officer*

JAMES E. ROGAN
*Director of the United States Patent and Trademark Office*